US011111129B2

(12) United States Patent
Ikushima

(10) Patent No.: US 11,111,129 B2
(45) **Date of Patent: *Sep. 7, 2021**

(54) LIQUID MATERIAL EJECTOR

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Mitaka (JP)

( * ) Notice: Subject to any disclaimer, the term of this patent is extended or adjusted under 35 U.S.C. 154(b) by 348 days.

This patent is subject to a terminal disclaimer.

(21) Appl. No.: 15/933,481

(22) Filed: Mar. 23, 2018

(65) Prior Publication Data

US 2018/0208450 A1 Jul. 26, 2018

Related U.S. Application Data

(62) Division of application No. 14/286,214, filed on May 23, 2014, now Pat. No. 9,957,150, which is a division (Continued)

(30) Foreign Application Priority Data

Oct. 21, 2005 (JP) ..... 2005-307610

(51) Int. Cl.
*B67D 7/16* (2010.01)
*B05C 5/02* (2006.01)

(Continued)

(52) U.S. Cl.
CPC ..... *B67D 7/16* (2013.01); *B05C 5/0229* (2013.01); *B67D 7/428* (2013.01); *B67D 7/64* (2013.01);

(Continued)

(58) Field of Classification Search
CPC .. B67D 7/16; B67D 7/64; B67D 7/428; B05C 5/0229; Y10T 137/86871; Y10T 137/86863
See application file for complete search history.

(56) References Cited

U.S. PATENT DOCUMENTS 5,119,973 A 6/1992 Miller et al.
5,671,873 A * 9/1997 Hammerl ..... F04B 7/0076 222/309

(Continued)

FOREIGN PATENT DOCUMENTS

JP S64-37271 A 2/1989
JP 2-26980 A 1/1990

(Continued)

OTHER PUBLICATIONS

Office Action dated Jan. 24, 2017, issued in counterpart Taiwanese Application No. 104101936, with English translation of Search Report as the concise statement of relevance. (14 pages).

(Continued)

*Primary Examiner* — Qingzhang Zhou
(74) *Attorney, Agent, or Firm* — Westerman, Hattori, Daniels & Adrian, LLP

(57) ABSTRACT

The liquid material ejector has a liquid material supply port through which the liquid material is supplied, a nozzle for ejecting the liquid material, a valve block having a metering bore to be filled with the ejected liquid material and a liquid material supply channel communicating with the liquid material supply port, a selector valve having a first channel for allowing communication between the metering bore and the liquid material supply channel and a second channel for allowing communication between the metering bore and the nozzle, a plunger advancing and retracting in the metering bore, a plunger driving section for driving the plunger, a valve driving section for driving the selector valve, and a (Continued)

transmission section for transmitting driving power from the valve driving section to the selector valve. The plunger driving section, the valve driving section, and the valve block are arranged successively in the longitudinal direction.

8 Claims, 14 Drawing Sheets

Related U.S. Application Data of application No. 12/090,905, filed as application No. PCT/JP2006/320924 on Oct. 20, 2006, now Pat. No. 8,763,860.

(51) Int. Cl.
*B67D 7/42* (2010.01)
*B67D 7/64* (2010.01)

(52) U.S. Cl.
CPC ..... *Y10T 137/86863* (2015.04); *Y10T 137/86871* (2015.04)

(56) References Cited

U.S. PATENT DOCUMENTS 5,671,903 A 9/1997 Homma et al.
6,050,450 A 4/2000 Gardos
6,811,058 B2 * 11/2004 Voskuil ..... F16K 11/0876 222/135
2004/0182887 A1 9/2004 Sugimura et al.
2005/0061391 A1 3/2005 Ikushima
2005/0063839 A1 3/2005 Kazumasa
2005/0067438 A1 * 3/2005 Ikushima ..... B05C 5/0225 222/386
2005/0072815 A1 4/2005 Carew et al.
2005/0161847 A1 7/2005 Weatherall et al.
2005/0170093 A1 8/2005 Chung et al.
2011/0139814 A1 6/2011 Mueller et al.

FOREIGN PATENT DOCUMENTS

JP 02-253030 A 10/1990
JP 2001-227456 A 8/2001
JP 2003-93942 A 4/2003
JP 2003-126750 A 5/2003
JP 2004-160314 A 6/2004
JP 2004-283714 A 10/2004
JP 2004-71967 A 3/2007

OTHER PUBLICATIONS

European Search Report dated Nov. 9, 2009, issued in correspondong European Patent Applicaton No. 06821985.6.
International Search Report of PCT/JP2006/320924, dated Nov. 28, 2006.

* cited by examiner

[Fig. 1]
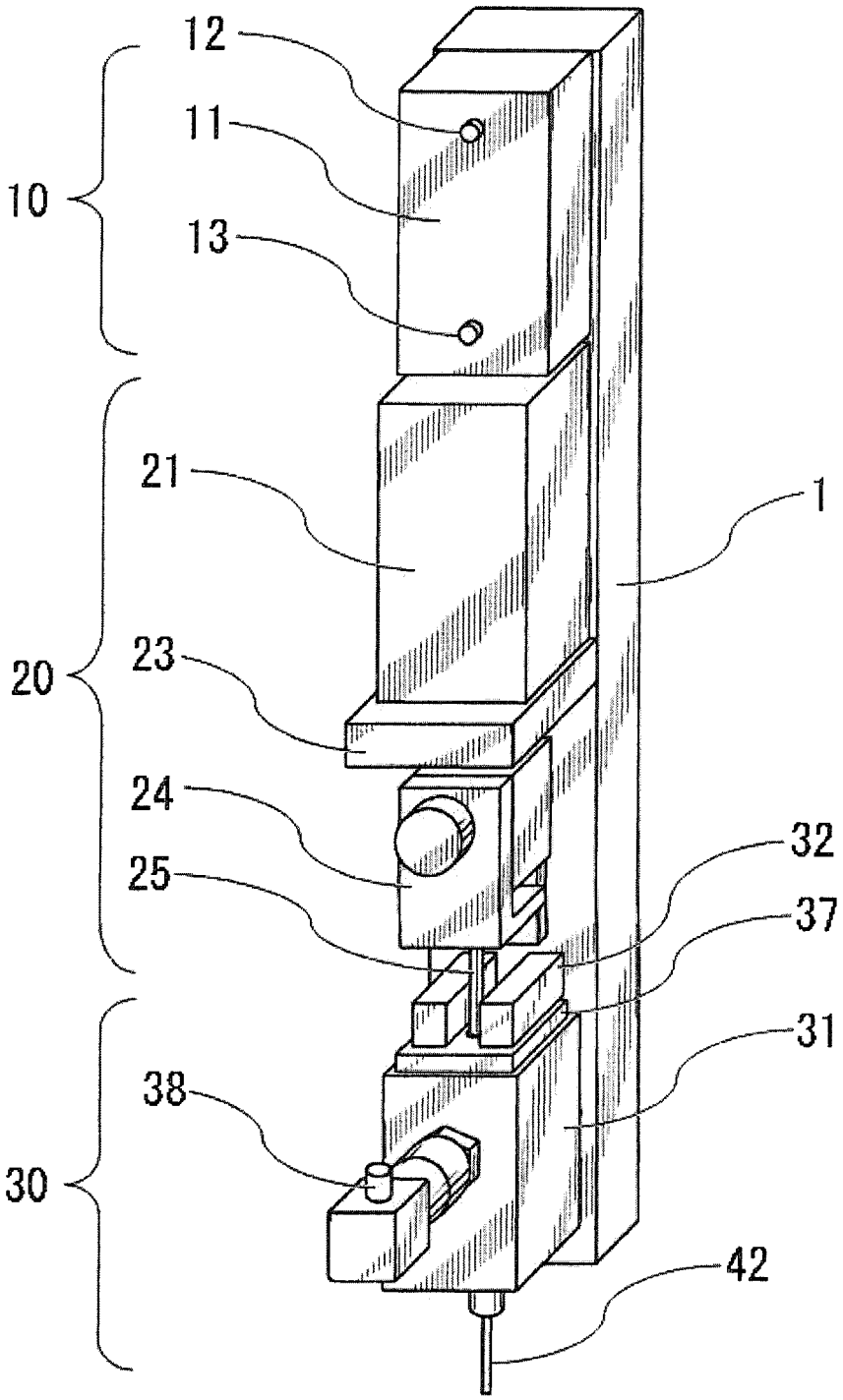

[Fig. 2]
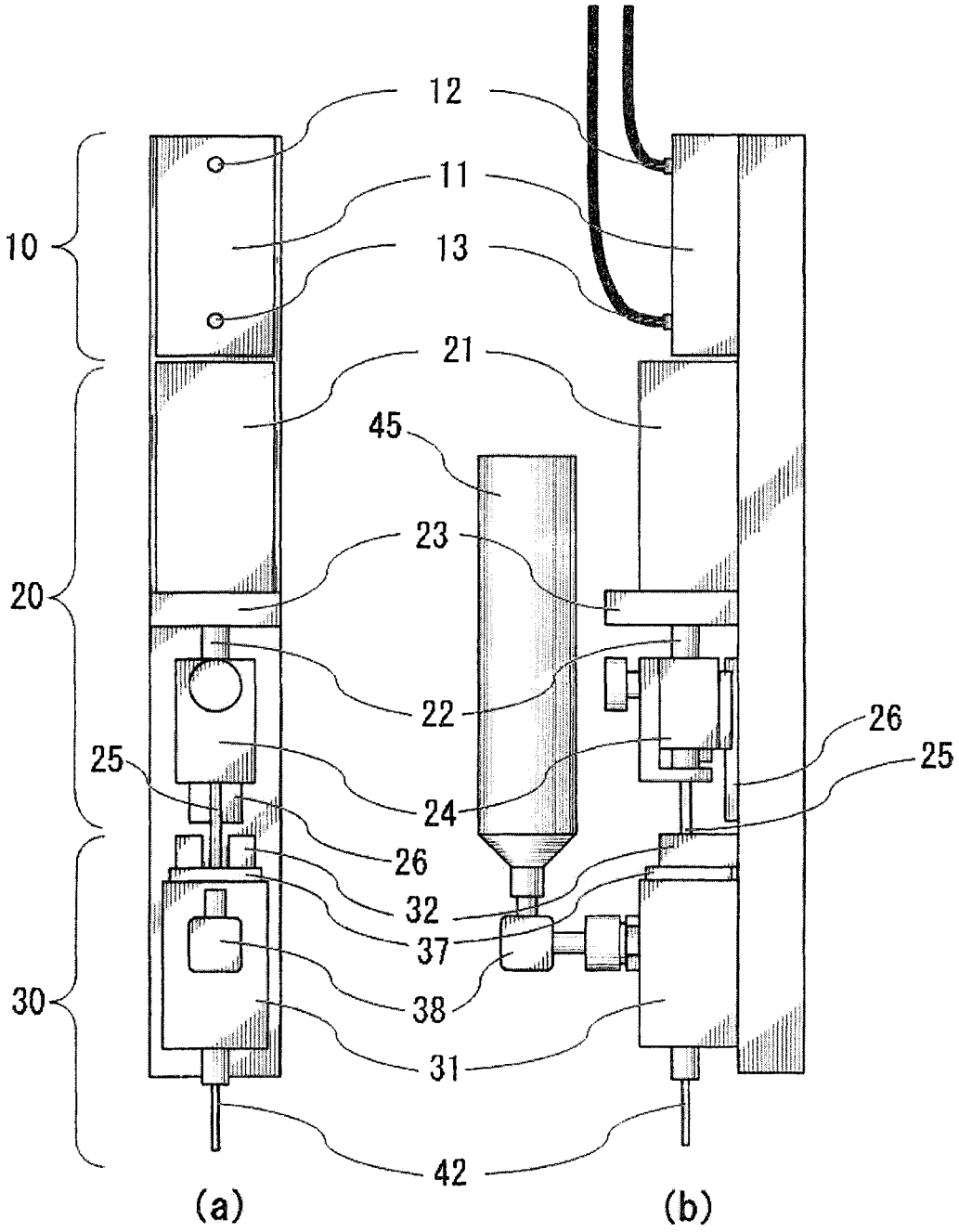

[Fig. 3]
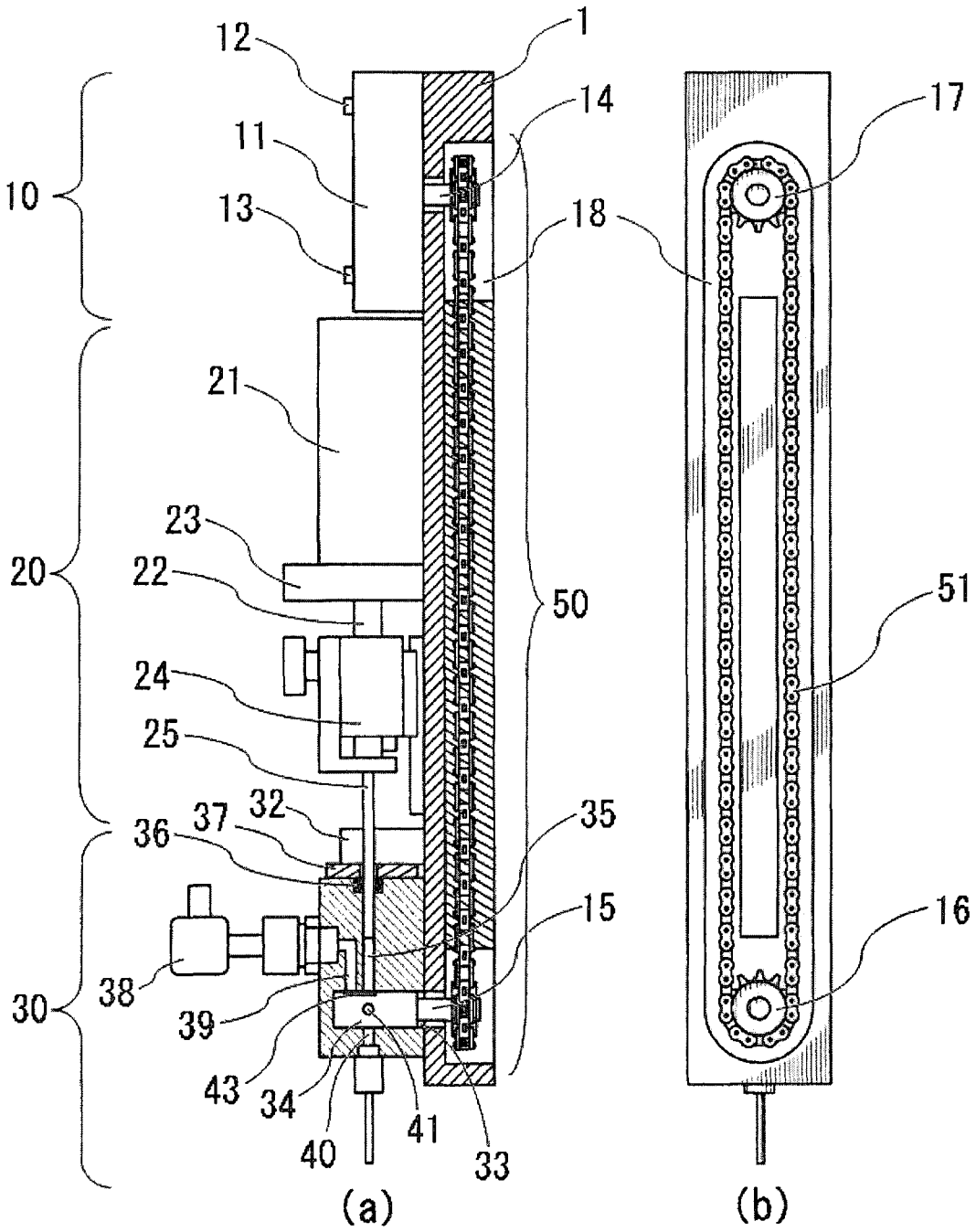

[Fig. 4]
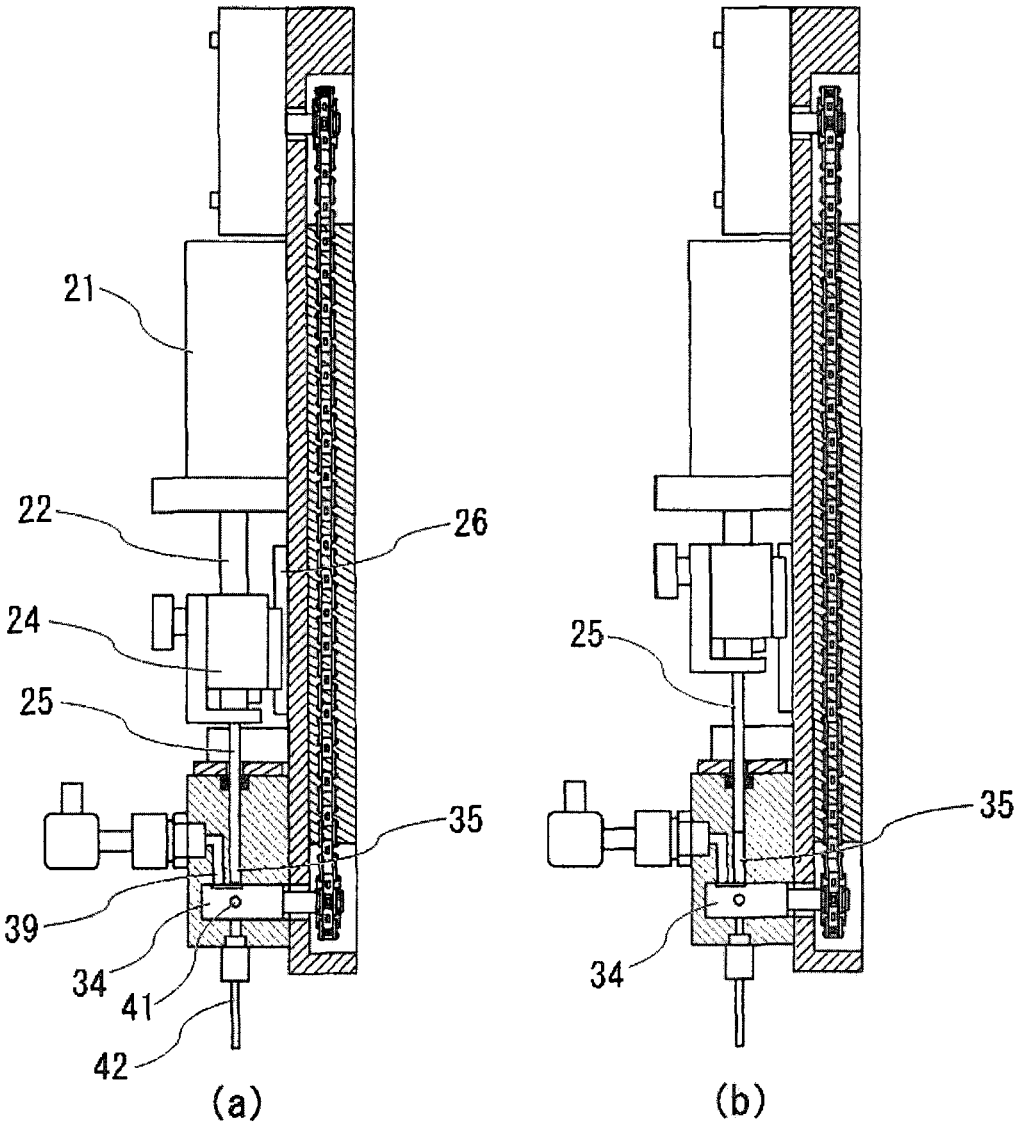

[Fig. 5]
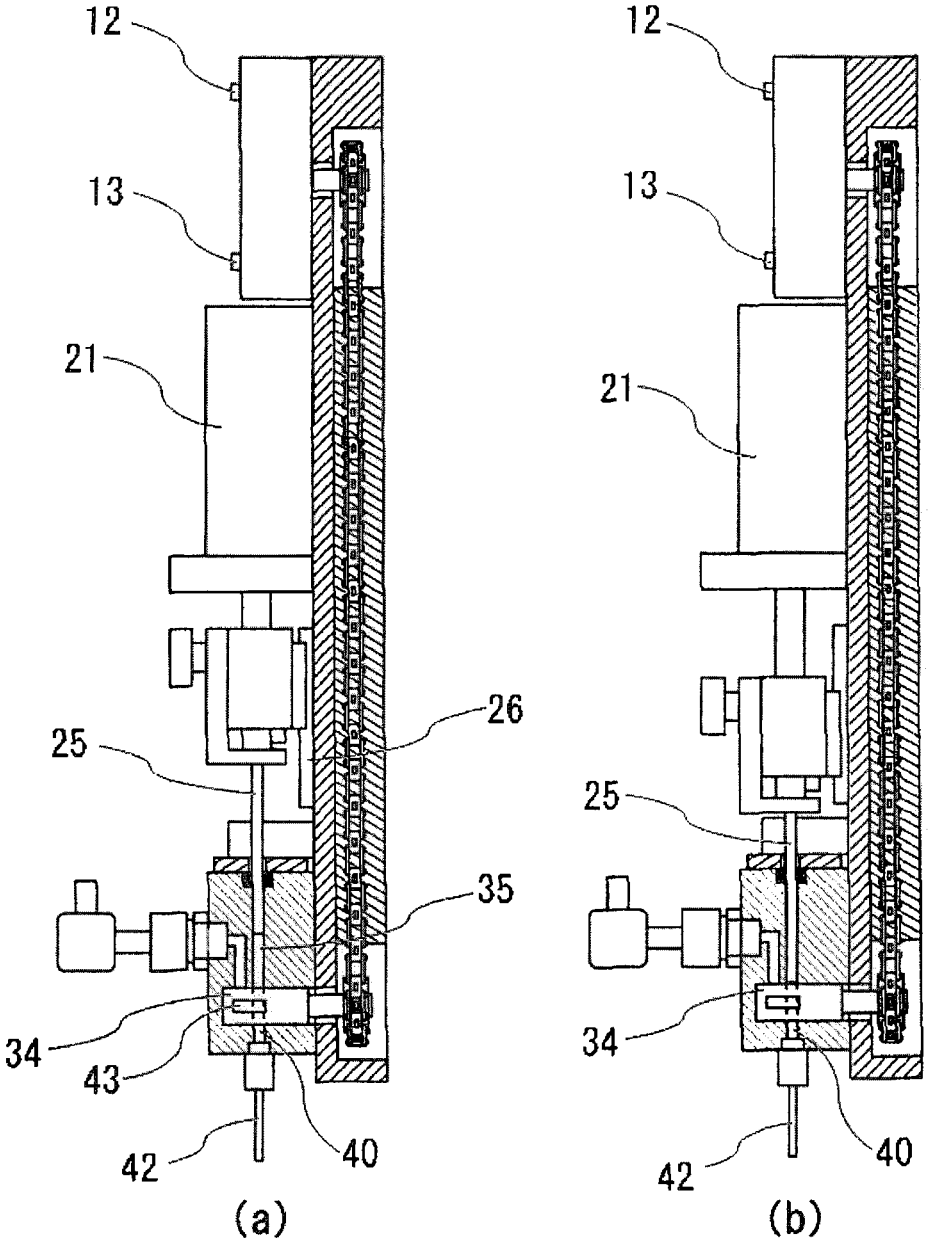

[Fig. 6]
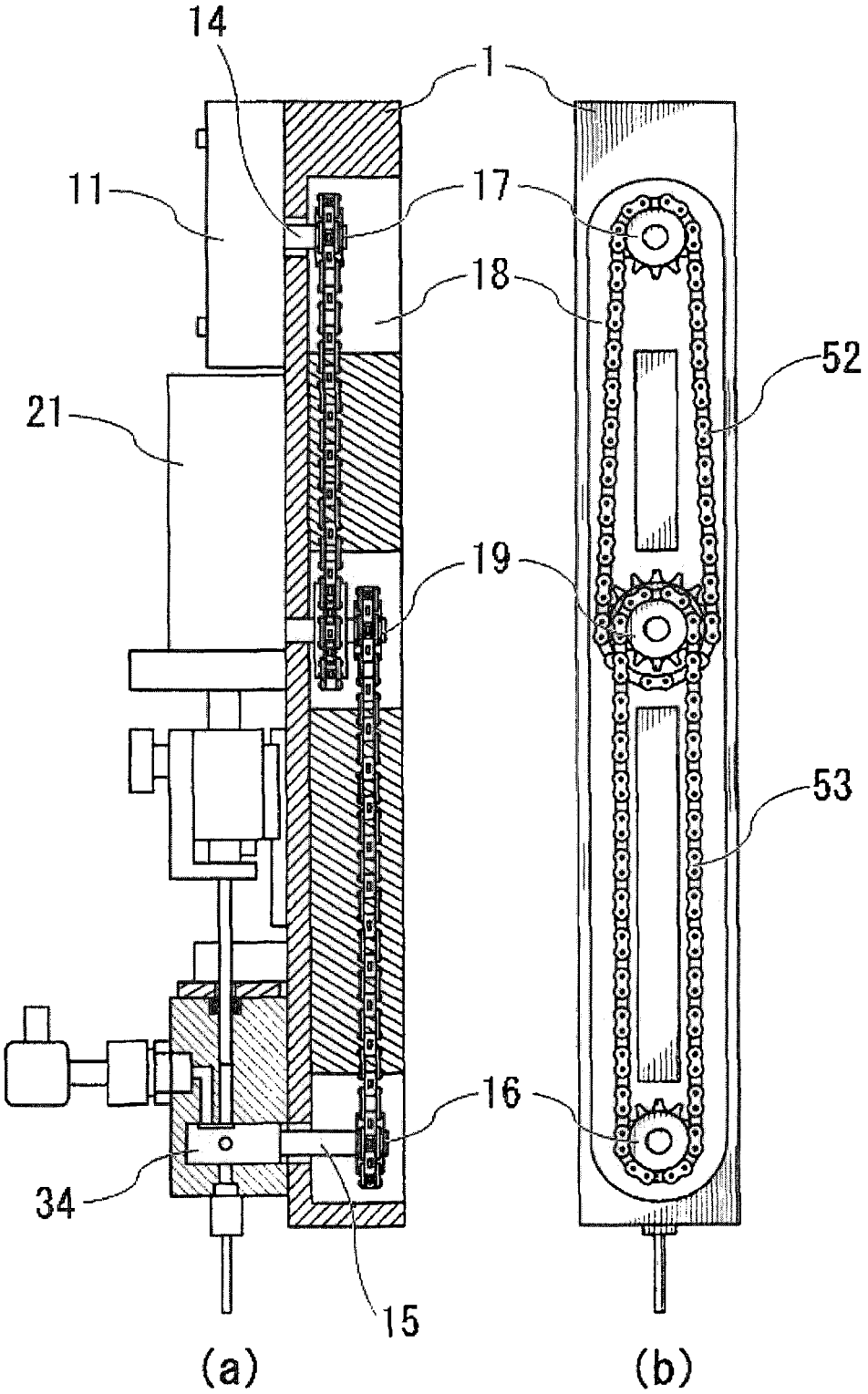

[Fig. 7]
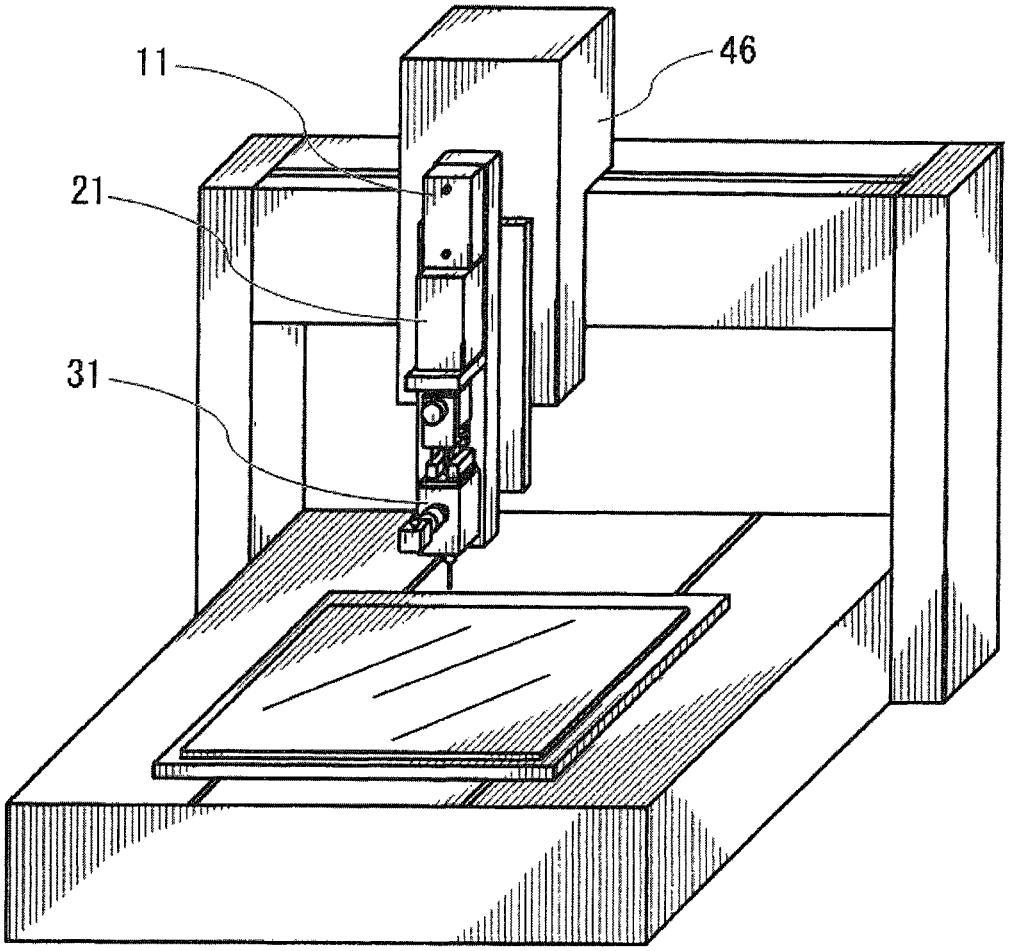

[Fig. 8]
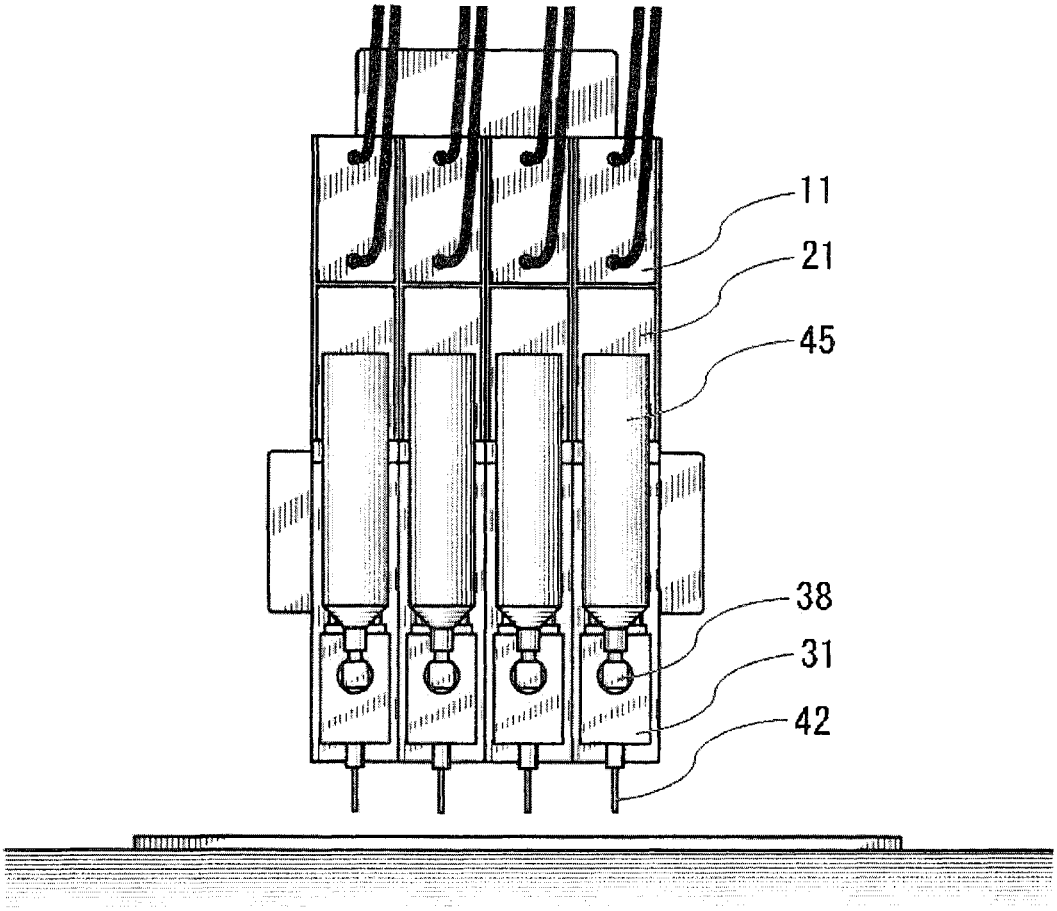

[Fig. 9]
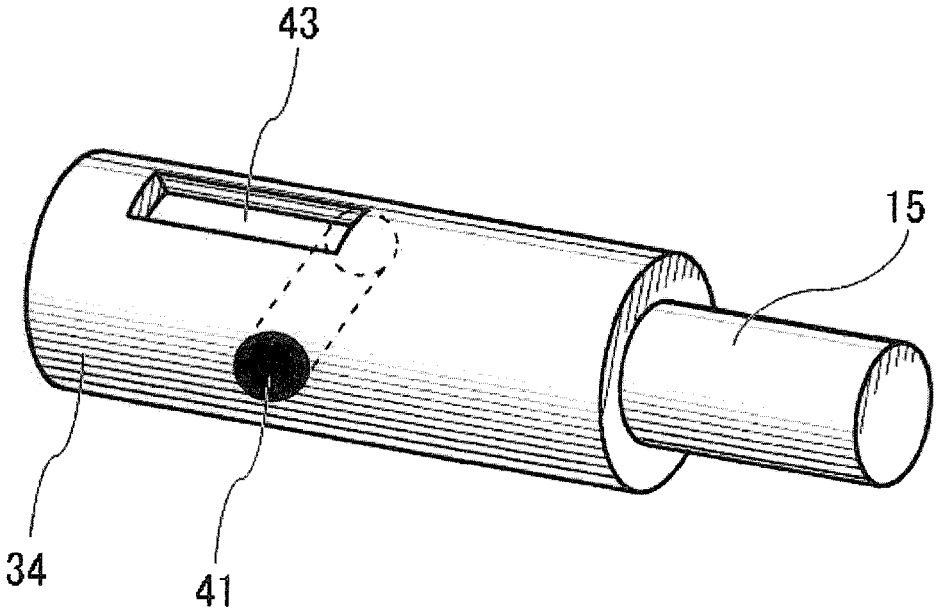

[Fig. 10]
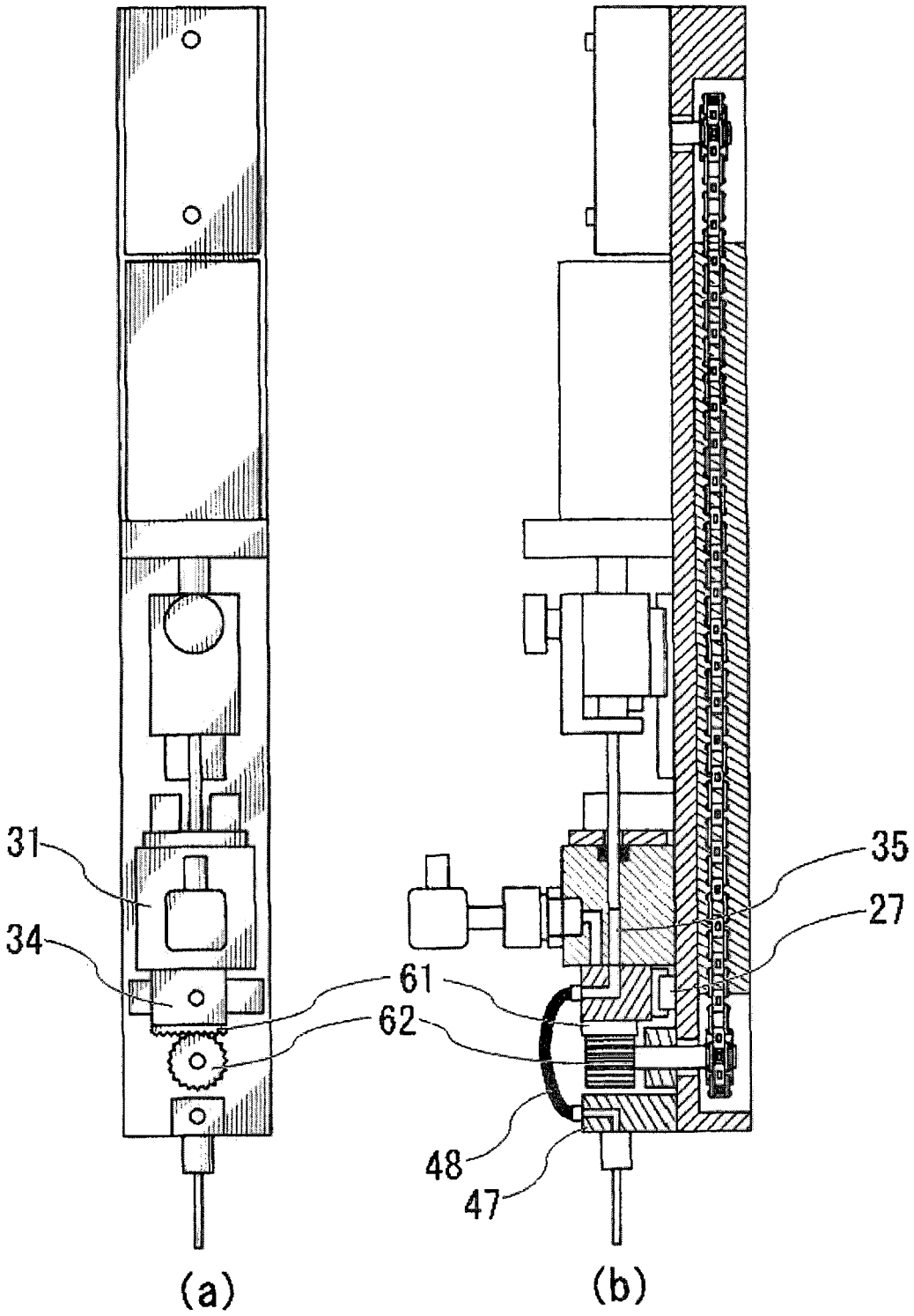

[Fig. 11]
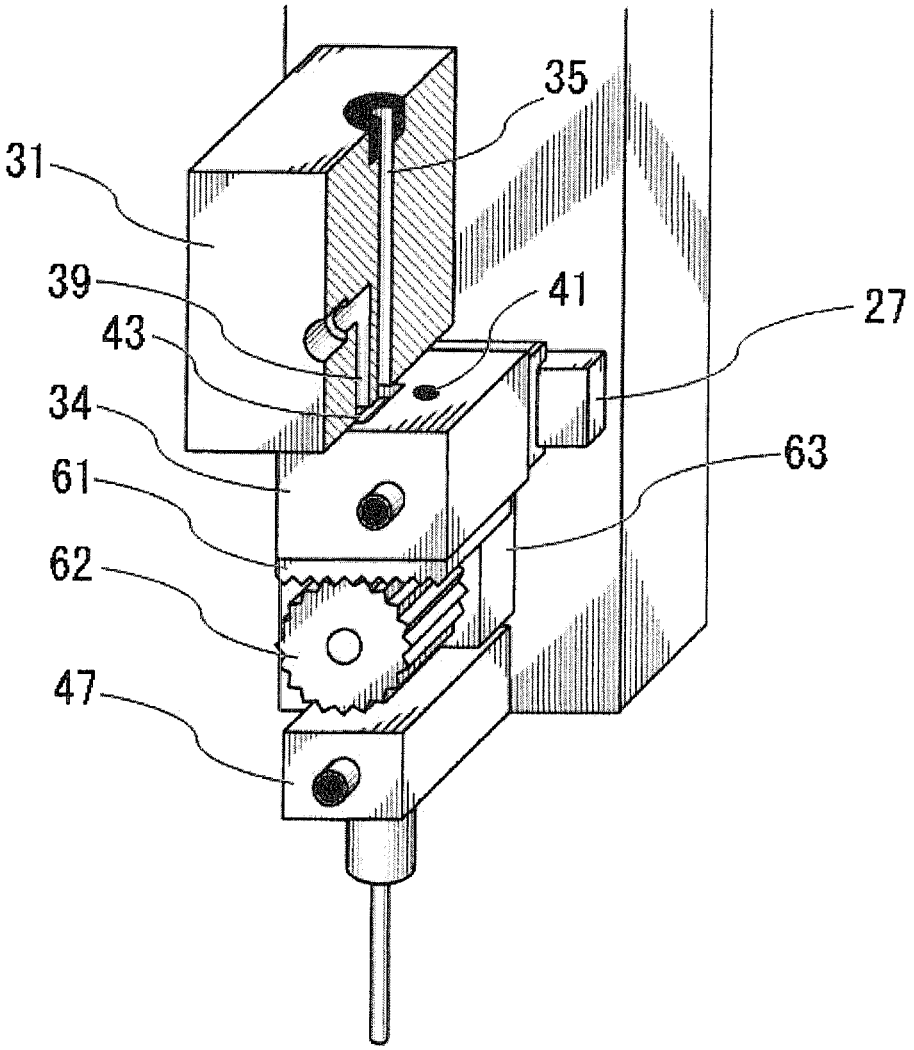

[Fig. 12]
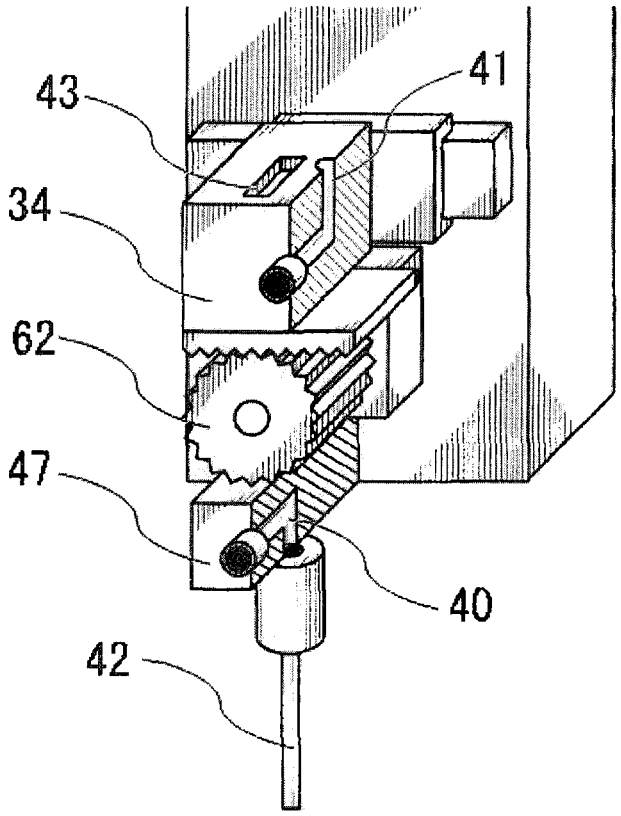

[Fig. 13]
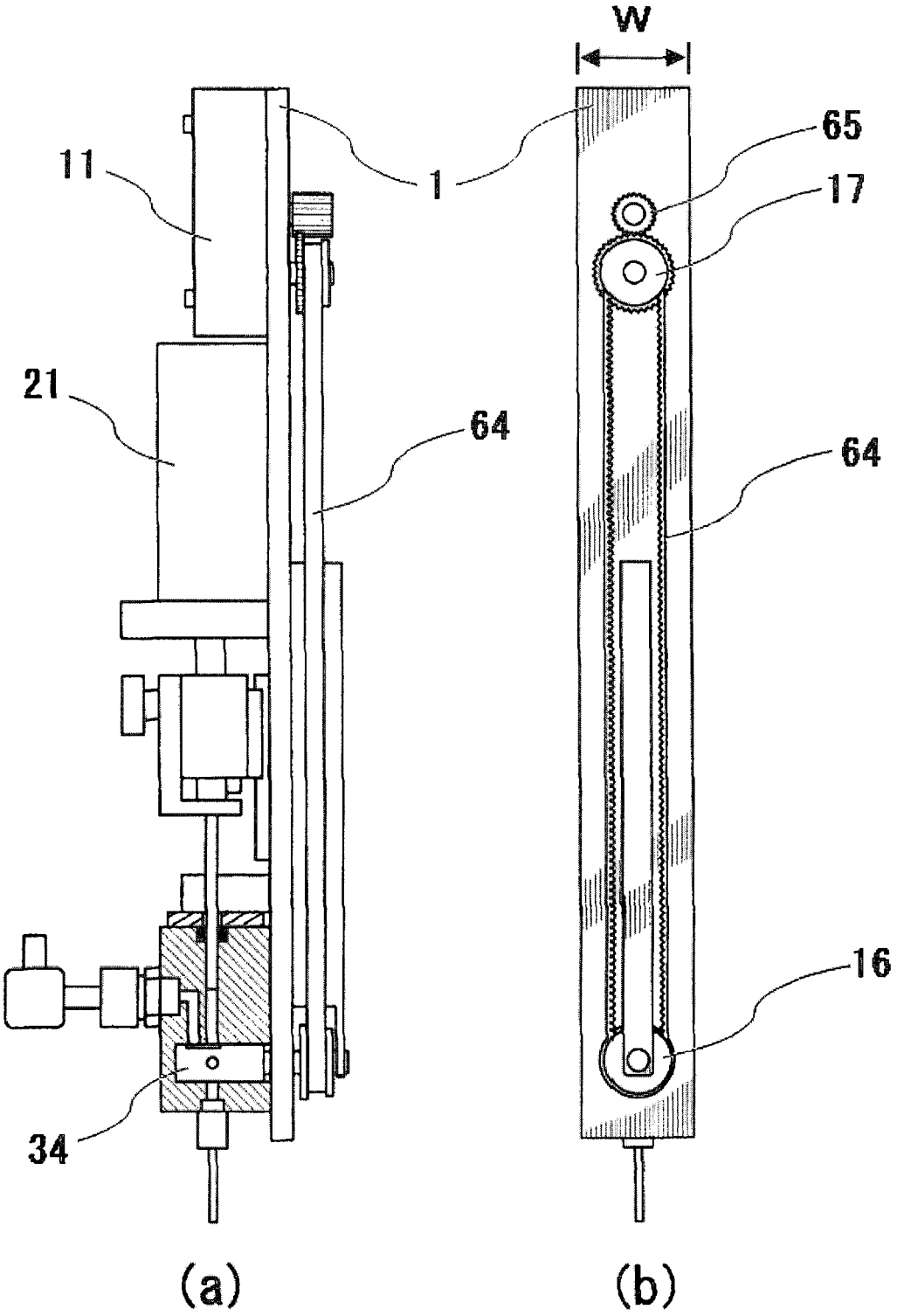

[Fig. 14]
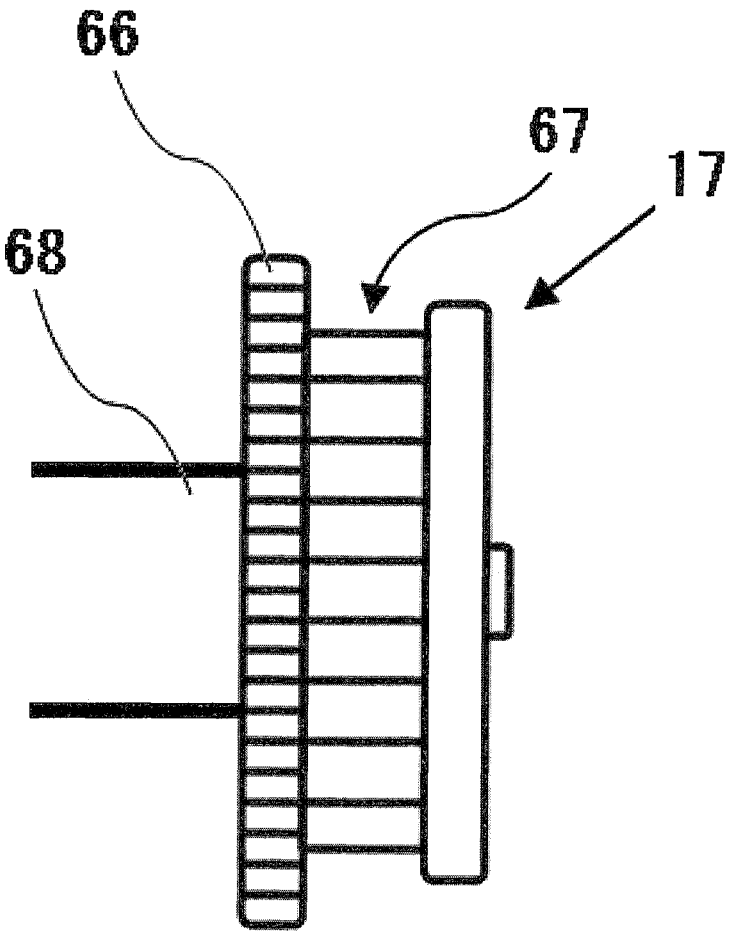

LIQUID MATERIAL EJECTOR

CROSS-REFERENCE TO RELATED APPLICATIONS

This is a continuation application of U.S. patent application Ser. No. 14/286,214, filed on May 23, 2014, which is a divisional application of U.S. patent application Ser. No. 12/090,905, filed on May 27, 2009, which is a 371 of International Application No. PCT/JP2006/320924, filed on Oct. 20, 2006, which claims the benefit of priority from the prior Japanese Patent Application No. 2005-307610 filed on Oct. 21, 2005, the entire contents of which are incorporated herein by references.

TECHNICAL FIELD

The present invention relates to a liquid material ejector capable of ejecting a liquid material of any viscosity ranging, for example, from a low viscosity material, such as water and alcohol, to a fluid with high consistency, such an adhesive and a paste- or a cream-like industrial material.

BACKGROUND ART

As one example of an apparatus for ejecting a liquid material with advancing/retracting movements of a plunger which slides along an inner surface of a pipe, there is known an apparatus comprising a liquid material reservoir for storing the liquid material, a nozzle portion for ejecting the liquid material, a liquid feed channel for communicating the reservoir and the nozzle portion with each other, a plunger portion having a seal portion sliding in close contact with an inner surface of the liquid feed channel, and plunger moving means for advancing and retracting the plunger portion, wherein the apparatus further comprises another liquid feed channel for communicating part of the aforesaid liquid feed channel near its distal end on the nozzle side with part of the aforesaid liquid feed channel near the liquid material reservoir or with the liquid material reservoir, and a liquid feed valve disposed at the distal end of the aforesaid liquid feed channel or midway the aforesaid liquid feed channel. As an embodiment of the apparatus, an apparatus including an ejection valve (liquid feed valve) extending laterally with respect to the advancing/retracting direction of the plunger is illustrated (Patent Document 1).

Also, there is disclosed an apparatus comprising a pump portion for metering an ejected liquid material in a desired amount, a valve portion for selectively changing over liquid material channels for suction and discharge, a reservoir portion storing the liquid material and being able to communicate with the pump portion depending on a position of the valve portion, and an ejection portion provided with an ejection port through which the liquid material is ejected, wherein the pump portion and the valve portion are disposed successively in an adjacent relation. As an embodiment of the apparatus, the following arrangement is illustrated and described; namely, a valve block serving as one component of the valve portion is disposed on one lateral side of a cylinder block serving as one component of the pump portion, the cylinder block and the valve block are held in close contact with each other by causing the cylinder block to be pressed against and fixed to the valve block through a pushing member at a distal end of an air cylinder by the action of air pressure supplied from air control means, and the valve block is caused to slide in contact with the cylinder block by an air cylinder which is disposed on the backside of the valve block (Patent Document 2).

Thus, in order to obtain power necessary for operating the valve, it is required in the prior art to provide a valve driving source in layout extending laterally with respect to the advancing/retracting direction of the plunger as in Patent Document 1, or to provide it in a position opposing to the plunger with the valve interposed therebetween or on the backside of the valve as in Patent Document 2.

Patent Document 1: Japanese Patent Laid-Open No. 2003-126750

Patent Document 2: Japanese Patent Laid-Open No. 2001-227456

DISCLOSURE OF THE INVENTION

Problems to be Solved by the Invention

With the prior-art apparatus in which the valve driving source is arranged in a position near the nozzle, however, the valve driving source has a structure projecting in the horizontal direction with respect to the advancing/retracting direction of the plunger. It is hence difficult to arrange a plurality of ejectors side by side. In other words, the prior-art apparatus has the problem that, when liquid material ejectors are arranged side by side, the interval between the ejectors arranged side by side is restricted by the size of the valve driving source.

Further, to be adaptable for ejecting a liquid material of high viscosity, a large driving force is required to change over the valve. For that reason, the apparatus is limited in its application to a liquid material of low viscosity when the apparatus size should be kept compact.

In view of the state of the art described above, an object of the present invention is to provide a liquid material ejector which is adaptable for a liquid material of any viscosity, which has a structure where any part of the ejector has neither unnecessary projection nor extension in the horizontal direction with respect to the advancing/-retracting direction of a plunger, and which enables a plurality of ejectors to be arranged side by side in a closely adjacent relation.

Means for Solving the Problems

Based on the finding that the above-mentioned problem with the prior art is attributable to the valve driving source being arranged in the horizontal direction, the inventor has realized saving of a space in the horizontal direction by arranging the valve driving source in the longitudinal direction of the base block.

More specifically, a first aspect of the present invention resides in a liquid material ejector comprising a liquid material supply port through which the liquid material is supplied, a nozzle for ejecting the liquid material, a valve block (31) having a metering bore to be filled with the ejected liquid material and a liquid material supply channel communicating with the liquid material supply port, a selector valve having a first channel for allowing communication between the metering bore and the liquid material supply channel and a second channel for allowing communication between the metering bore and the nozzle, a plunger advancing and retracting in the metering bore, a plunger driving section (20) for driving the plunger, a valve driving section (10) for driving the selector valve, and a transmission section (50) for transmitting driving power from the valve driving section to the selector valve, wherein the plunger driving section (20), the valve driving section (10), and the valve block (31) are arranged successively in the longitudinal direction.

According to a second aspect of the present invention, in the first aspect of the present invention, the valve block (31) has a valve bore communicating with the liquid material supply channel, the nozzle, and the metering bore, the selector valve is a cylindrical rotary valve which is rotatable while sliding in contact with an inner wall of the valve bore, the first channel is a recessed groove formed in a circumferential surface of the cylindrical rotary valve, and a second channel is a through-bore diametrically penetrating the cylindrical rotary valve.

According to a third aspect of the present invention, in the first aspect of the present invention, the valve block (31) has respective one ends of the liquid material supply channel and the metering bore, which are positioned in a sliding contact surface thereof with the selector valve, the selector valve is a slide valve which slides in surface contact with the valve block (31), the first channel is a recessed groove formed in a sliding contact surface of the selector valve with respect to the valve block (31), and a second channel is a bore communicating the sliding contact surface of the selector valve with respect to the valve block (31) and another surface of the selector valve with each other.

According to a fourth aspect of the present invention, in the first, second or third aspect of the present invention, the plunger driving section (20), the valve driving section (10), and the valve block (31) are arranged on the front side of a base block, and the transmission section (50) is disposed on the backside of the base block.

According to a fifth aspect of the present invention, in any one of the first to fourth aspects of the present invention, the transmission section (50) comprises a main drive gear (17) connected to the valve driving section (10), a subordinate driven gear (16) connected to the selector valve, and a power transmission belt for transmitting a driving force of the main drive gear (17) to the subordinate driven gear (16).

According to a sixth aspect of the present invention, in the fifth aspect of the present invention, the liquid material ejector further comprises a variable gear (19) which is disposed intermediate between the main drive gear (17) and the subordinate driven gear (16) and which is comprising of a first gear and a second gear coaxially fixed, the first gear and the second gear providing a different gear ratio, wherein the power transmission belt comprises a first power transmission belt stretched between the main drive gear (17) and the first gear and a second power transmission belt stretched between the subordinate driven gear (16) and the second gear.

According to a seventh aspect of the present invention, in the fifth or sixth aspect of the present invention, the main drive gear (17) is comprising of a larger-diameter gear (66) and a smaller-diameter gear (67) coaxially fixed, the smaller-diameter gear providing a smaller gear ratio than the larger-diameter gear, the valve driving section (10) and the main drive gear (17) are connected to each other by engaging an auxiliary gear (65), which is connected to the valve driving section (10), with the larger-diameter gear (66), and the driving force of the main drive gear (17) is transmitted to the subordinate driven gear (16) through the power transmission belt looped over the smaller-diameter gear (67).

According to an eighth aspect of the present invention, in the fifth, sixth or seventh aspect of the present invention, the power transmission belt is comprising of a chain belt.

According to a ninth aspect of the present invention, in the fifth, sixth or seventh aspect of the present invention, the power transmission belt is comprising of a timing belt.

According to a tenth aspect of the present invention, in any one of the first to ninth aspects of the present invention, the valve driving section (10) is comprising of a rotary actuator.

According to an eleventh aspect of the present invention, in any one of the first to tenth aspects of the present invention, the plunger driving section (20) is comprising of a stepping motor.

A twelfth aspect of the present invention resides in a liquid application apparatus having a head section in which a plurality of liquid material ejectors according to any one of the first to eleventh aspects of the present invention are arranged side by side in a closely adjacent relation in the lateral direction.

Effect of the Invention

According to the present invention, since the liquid material ejector can be constructed to be adaptable for a liquid material of any viscosity and to have a slim shape extending in the advancing/-retracting direction of the plunger, a plurality of the liquid material ejectors can be arranged side by side in a closely adjacent relation in the horizontal direction with respect to the advancing/retracting direction of the plunger.

Further, when the liquid material ejector of the present invention is mounted on an application apparatus, the size of an application head having an ejection port through which the liquid material is ejected can be reduced and many heads can be arranged side by side at a smaller interval.

BRIEF DESCRIPTION OF THE DRAWINGS

FIG. 1 is an external appearance perspective view of a liquid material ejector according to Embodiment 1.

FIG. 2 illustrates the liquid material ejector according to Embodiment 1 in which FIG. 2(*a*) is a front view and FIG. 2(*b*) is a side view.

FIG. 3 illustrates the liquid material ejector according to Embodiment 1 in which FIG. 3(*a*) is a side sectional view and FIG. 3(*b*) is a rear view.

FIG. 4 is a side sectional view (½) for explaining the operation of the liquid material ejector according to Embodiment 1.

FIG. 5 is a side sectional view (2/2) for explaining the operation of the liquid material ejector according to Embodiment 1.

FIG. 6 illustrates a liquid material ejector according to Embodiment 2 in which FIG. 6(*a*) is a side sectional view and FIG. 6(*b*) is a rear view.

FIG. 7 is an external appearance perspective view of a liquid material application apparatus equipped with the liquid material ejector according to the present invention.

FIG. 8 is a simplified external appearance view showing the case where a plurality of liquid material ejectors according to the present invention are arranged side by side in a closely adjacent relation.

FIG. 9 is a simplified external appearance view of a selector valve in the present invention.

FIG. 10 illustrates a liquid material ejector according to Embodiment 3 in which FIG. 10(*a*) is a front view and FIG. 10(*b*) is a side sectional view.

FIG. 11 is a perspective sectional view (½) of a valve section of the liquid material ejector according to Embodiment 3.

FIG. 12 is a perspective sectional view (2/2) of the valve section of the liquid material ejector according to Embodiment 3.

FIG. 13 illustrates a liquid material ejector according to Embodiment 4 in which FIG. 13(*a*) is a side sectional view and FIG. 13(*b*) is a rear view.

FIG. 14 is a side view of an auxiliary gear in Embodiment 4.

DESCRIPTION OF REFERENCE CHARACTERS

A legend of main reference characters used in the drawings is as follows:

1 base block/10 valve driving section/11 rotary actuator/12 air supply port A/13 air supply port B/14 rotary shaft A/15 rotary shaft B/16 subordinate driven gear/17 main drive gear/18 recess/19 variable gear/20 plunger driving section/21 directly-operating actuator/22 actuator rod/23 fixing plate/24 joint portion/25 plunger rod/26 slide rail A/27 slide rail B/30 valve section/31 valve block/32 valve block guide/33 valve bore/34 selector valve/35 metering bore/36 O-ring/37 O-ring retainer/38 liquid material supply port/39 liquid material supply channel/40 liquid material discharge channel/41 through-hole/42 nozzle/43 recessed groove/45 liquid material reservoir/46 support post/47 nozzle support/48 liquid feed tube/50 transmission section/51 chain/52 chain A/53 chain B/61 rack/62 pinion/63 bearing/64 timing belt/65 auxiliary gear/66 gear C/67 gear D/68 rotary shaft D

BEST MODE FOR CARRYING OUT THE INVENTION

The best mode for carrying out the present invention will be described below in connection with embodiments, but the present invention is in no way restricted by the following embodiments.

Embodiment 1

<<Construction>>

A liquid material ejector of this embodiment comprises a valve driving section 10, a plunger driving section 20, a valve section 30, and a transmission section 50, and a base block 1 on which those sections are disposed. FIG. 1 is a front perspective view of the ejector of this embodiment. FIG. 2 depicts, on the left side, a front view and, on the right side, a side view showing a state where a liquid material reservoir 45 and an air tube are mounted. Components of the ejector will be described in detail below.

The base block 1 has an elongate shape extending substantially over the entire length of the ejector. The valve driving section 10, the plunger driving section 20, and the valve section 30 are disposed on a front surface of the base block 1, and a recess 18 is formed in a rear surface of the base block 1 to accommodate the transmission section comprising gears and a chain. The ejector of this embodiment is used, as shown in FIG. 7, as a head section of a liquid material application apparatus by mounting the base block 1 to a support post 46 in a manner movable to the right and left. On that occasion, the construction of this embodiment enables a plurality of ejectors to be arranged side by side in a closely adjacent relation, as shown in FIG. 8. With the ejector of this embodiment, the width of the base block 1 can be reduced to 3 cm or less.

The valve driving section 10 is comprising of a rotary actuator 11 having an air supply port A 12 and an air supply port B 13. The rotary actuator 11 supplies air to one of the air supply port A 12 and the air supply port B 13 and discharges air from the other port, thus causing a rotary shaft A 14 to be rotated through a predetermined angle. By changing over the supply and the discharge of air with respect to the air supply port A 12 and the air supply port B 13, the rotary shaft A 14 is rotated in the reversed direction through a predetermined angle. As shown in FIG. 3, the rotary shaft A 14 penetrates a through-hole formed in the base block 1 and is connected to a main drive gear 17 which is disposed within the recess 18, thereby transmitting a driving force to the transmission section 50.

The plunger driving section 20 comprises a directly-operating actuator 21 fixed by using a fixing plate 23, an actuator rod 22 for transmitting driving power of the actuator 21, a joint portion 24 provided with a plunger rod 25, and a slide rail A 26 along which the joint portion 24 is movable in the vertical direction.

The fixing plate 23 has a through-hole through which the actuator rod 22 penetrates. The actuator rod 22 is advanced and retracted by driving the directly-operating actuator 21, whereby the plunger rod 25 is also advanced and retracted through the joint portion 24 held on the slide rail A 26.

The valve section 30 comprises a substantially parallelepiped valve block 31, a valve block guide 32, a valve block 34, an O-ring retainer 37, and a liquid material supply port 38.

A valve bore 33 is horizontally formed inside the valve block 31. A metering bore 35 for communicating the valve bore 33 with an upper surface of the valve block 31 and a liquid material discharge channel 40 for communicating the valve bore 33 with a nozzle 42 are vertically formed inside the valve block 31.

The selector valve 34 having a cylindrical shape is arranged inside the valve bore 33 such that its center axis lies horizontally. As shown in FIG. 9, the selector valve 34 in this embodiment has a through-hole 41 and a recessed groove 43, and it is rotated while sliding along an inner surface of the valve bore 33. When the through-hole 41 is positioned to face the metering bore 35, the nozzle 42 and the metering bore 35 are communicated with each other, and when the recessed groove 43 is positioned to face the metering bore 35, the metering bore 35 and the liquid material supply channel 39 are communicated with each other.

One end of the selector valve 34 is coupled to a rotary shaft B 15. The rotary shaft B 15 penetrates a through-hole formed in the base block 1, and an end of the rotary shaft B 15 on the side away from the selector valve 34 is connected to a subordinate driven gear 16 which is disposed within the recess 18.

The plunger rod 25 is inserted in the metering bore 35 to fill and eject the liquid material when it is retracted and advanced. An O-ring 36 is fitted to an opening of the metering bore 35 and cooperates with the O-ring retainer 37, thus establishing sealing to prevent the liquid material in the metering bore 35 from leaking to the exterior. The O-ring retainer 37 is fixed in place by a valve block guide 32 disposed in the base block 1.

The liquid material supply port 38 is disposed in front of the valve block 31 and is communicated with the valve bore 33 through the liquid material supply channel 39. A coupling is connected as appropriate to the liquid material supply port 38, and a means for supplying the liquid material, e.g., a liquid material reservoir 45, is coupled to the upstream side of the liquid material supply port 38.

The transmission section 50 comprises the subordinate driven gear 16 and the main drive gear 17 which are disposed within the recess 18 of the base block 1, and a chain 51 stretched between both the gears.

The main drive gear 17 is coaxially connected to the rotary shaft A 14 of the rotary actuator 11, and the subordinate driven gear 16 is coaxially connected to the rotary shaft B 15 of the selector valve 34. When the rotary actuator 11 is operated, the rotary shaft A 14 is rotated forwards or backwards and the selector valve 34 is rotated in the valve block 31 through the chain 51.

<<Operation>>

Next, the operation of the ejector of this embodiment will be described with reference to FIGS. 4 and 5.

The ejector of this embodiment is basically operated through the steps of retracting the plunger rod 25 to fill the liquid material in the metering bore 35, and then advancing the plunger rod 25 to eject the liquid material in the metering bore 35 from a distal end of the nozzle 42. Details of the operation are described below.

FIG. 4*a* shows a state immediately before the liquid material is introduced to the metering bore 35 with the aid of the plunger rod 25. In that state, the plunger rod 25 is positioned closest to the selector valve 34, and the recessed groove 43 of the selector valve 34 is positioned upwards to communicate the liquid material supply channel 39 and the metering bore 35 with each other.

FIG. 4*b* shows a state where the liquid material is filled in the metering bore 35. With the retraction of the plunger rod 25, the liquid material in the liquid material reservoir 45 is filled in the metering bore 35 from the liquid material supply channel 39 through the recessed groove 43 of the selector valve 34.

Herein, the joint portion 24 is connected to the base block 1 in a slidable manner through the slide rail A 26 such that the plunger rod 25 can be smoothly retracted and advanced. After the plunger rod 25 has been retracted through a desired distance, the driving of the directly-operating actuator 21 is stopped to stop the plunger rod 25.

FIG. 5*a* shows a state where the metering bore 35 and the nozzle 42 are communicated with each other. By supplying air to the air supply port B 13 of the rotary actuator 11 and simultaneously opening the air supply port A 12 to the atmosphere to discharge air, the rotary shaft A 14 of the rotary actuator 11 is rotated to rotate the main drive gear 17 connected to the rotary shaft A 14. With the rotation of the main drive gear 17, the subordinate driven gear 16 is rotated through the chain stretched between the main drive gear 17 and the subordinate driven gear 16, and the selector valve 34 connected to the subordinate driven gear 16 is rotated through about 90 degrees. As a result, the selector valve 34 is positioned such that one end of the through-hole 41 of the selector valve 34 is communicated with the metering bore 35, and the other end of the through-hole 41 is communicated with the liquid material discharge channel 40. Thus, the metering bore 35 and the nozzle 42 are communicated with each other.

FIG. 5*b* shows a state where the liquid material filled in the metering bore 35 has been ejected. By driving the directly-operating actuator 21 to advance the actuator rod 22, the plunger rod 25 connected to the actuator rod 22 through the joint portion 24 is advanced, whereupon the liquid material in the metering bore 35 is ejected from the nozzle 42 through the liquid material discharge channel 40 after passing the through-hole 41 of the selector valve 34. After the plunger has been advanced through a desired distance, the driving of the directly-operating actuator 21 is stopped to stop the plunger rod 25.

Subsequently, by supplying air to the air supply port A 12 of the rotary actuator 11 and simultaneously opening the air supply port B 13 to the atmosphere to discharge air, the rotary shaft A 14 of the rotary actuator 11 is rotated backwards to rotate the main drive gear 17 connected to the rotary shaft A 14 backwards. With the backward rotation of the main drive gear 17, the subordinate driven gear 16 is also rotated backwards through the chain stretched between the main drive gear 17 and the subordinate driven gear 16, and the selector valve 34 connected to the subordinate driven gear 16 is rotated backwards. As a result, the selector valve 34 is brought into a state (shown in FIG. 4*a*) where the metering bore 35 and the liquid material supply channel 39 are communicated with each other through the recessed groove 43 of the selector valve 34.

Thereafter, the liquid material can be continuously ejected by repeating the above-described operation in the same manner.

Embodiment 2

An ejector of this Embodiment 2 differs from the ejector of Embodiment 1 in the construction of the transmission section 50, and the other construction is the same as that in the ejector of Embodiment 1.

In the ejector of this embodiment, as shown in FIG. 6, the transmission section 50 comprises the subordinate driven gear 16 and the main drive gear 17 which are disposed within the recess 18 of the base block 1, a variable gear 19 arranged between the gears 16 and 17, and chains 52 and 53 stretched respectively between two of those three gears.

The variable gear 19 is comprising of a larger-diameter gear A and a smaller-diameter gear B coaxially connected to each other, the gear A and the gear B capable of providing a different gear ratio. The gear A and the gear B are just simply fixed in a coaxial relation such that they are not rotated independently of each other and when one gear is rotated through a predetermined angle, the other gear is also rotated through the same predetermined angle. Additionally, a rotary shaft C of the variable gear 19 is rotatably disposed with respect to the base block 1, and the variable gear 19 does not act to drive the other members disposed on the base block 1.

When the rotary shaft A 14 is rotated by the rotary actuator 11, the main drive gear 17 coaxially connected to the rotary shaft A 14 is rotated to rotate the gear A of the variable gear 19 through the chain A 52. Since the rotation of the gear A is directly transmitted to the gear B which is coaxially connected to the gear A, the gear B is rotated through the same angle as the gear A, thereby rotating the subordinate driven gear 16 through the chain B 53. With the rotation of the subordinate driven gear 16, the selector valve 34 connected to the rotary shaft B 15 of the subordinate driven gear 16 can be rotated at the gear ratio of the variable gear 19. Herein, the term "gear ratio" means a ratio in the number of gear teeth. For example, when a gear having 30 teeth and a gear having 60 teeth are combined with each other, the gear ratio is given by 1:2 and a ratio in the number of rotations is conversely given by 2:1.

In the ejector of this embodiment, since the gear ratio is changed by using the variable gear 19, the selector valve 34 can be smoothly rotated by a larger force. Also, since the length of each chain can be shortened by arranging the variable gear 19 intermediate, the influence of elongation of the chain is reduced and the transmission of driving from the rotary actuator 11 can be more reliably performed. Still another effect is that the chain is less apt to slip off because of using a shorter chain.

Embodiment 3

An ejector of this Embodiment 3 differs from the ejector of Embodiment 1 in the construction of the valve section 30, and the other construction is the same as that in the ejector of Embodiment 1.

In the ejector of this embodiment, as shown in FIG. 10, a pinion 62 is connected to the rotary shaft B 15 which is rotated in conjunction with the subordinate driven gear 16, and the driving power from the transmission section 50 is transmitted to the selector valve 34 through a rack 61 engaging with the pinion 62. The selector valve 34 in this embodiment is a slide valve which slides in surface contact with the valve block 31 and which is disposed on the base block 1 such that it is movable to the right and left through a slide rail B 27.

The selector valve 34 has, in its surface held in sliding contact with the valve block 31, a recessed groove 43 and a through-hole 41 which is bored to extend in an L-shape from the sliding contact surface to a front surface of the selector valve 34 (see FIGS. 11 and 12). When the rotary shaft A 14 is rotated by the rotary actuator 11, the rotary shaft B 15 is rotated through the transmission section 50 and the pinion 62 is rotated. The rotation of the pinion 62 is converted to a linear motion by the rack 61, and the selector valve 34 fixed to the rack 61 is moved while sliding with respect to the valve block 31 such that one of the recessed groove 43 and the through-hole 41 is moved to a position facing the metering bore 35.

When the recessed groove 43 is located in the position facing the metering bore 35, the through-hole 35 and the liquid material supply channel 39 are communicated with each other through the recessed groove 43. When the through-hole 41 is located in the position facing the metering bore 35, the metering bore 35 and the nozzle 42 are communicated with each other through a flexible liquid feed tube 48 and the liquid material discharge channel 40, as well as the through-hole 41.

Embodiment 4

An ejector of this Embodiment 4 differs from the ejector of Embodiment 1 in the construction of the transmission section 50, and the other construction is the same as that in the ejector of Embodiment 1.

In the ejector of this embodiment, as shown in FIG. 13, the transmission section 50 comprises the subordinate driven gear 16 and the main drive gear 17 which are disposed on the backside of the base block 1, an auxiliary gear 65 engaging with the main drive gear 17, and a timing belt 64 stretched between the main drive gear 17 and the subordinate driven gear 16.

In this embodiment, the main drive gear 17 over which a power transmission belt is looped is engaged with the auxiliary gear 65 such that the main drive gear 17 is connected to the rotary shaft A 14 of the rotary actuator 11 through the auxiliary gear 65. Instead of the chain 51, the timing belt 64 is used as the power transmission belt. The timing belt 64 can be a well-known timing belt and is made of, e.g., synthetic rubber or polyurethane.

As shown in FIG. 14, the main drive gear 17 is comprising of a larger-diameter gear C 66 and a smaller-diameter gear D 67 coaxially connected to each other, the gear C 66 and the gear D 67 capable of providing a different gear ratio.

The gear C 66 and the gear D 67 are just simply fixed in a coaxial relation such that they are not rotated independently of each other and when one gear is rotated through a predetermined angle, the other gear is also rotated through the same predetermined angle. Additionally, a rotary shaft D 68 of the main drive gear 17 is rotatably disposed with respect to the base block 1, and the main drive gear 17 does not act to drive the other members disposed on the base block 1.

When the rotary shaft A 14 is rotated by the rotary actuator 11, the auxiliary gear 65 connected to the rotary shaft A 14 is rotated to rotate the gear C 66 of the main drive gear 17 engaging with the auxiliary gear 65. Since the rotation of the gear C 66 is directly transmitted to the gear D 67 which is coaxially connected to the gear C 66, the gear D 67 is rotated through the same angle as the gear C 66, thereby rotating the subordinate driven gear 16 through the timing belt 64. With the rotation of the subordinate driven gear 16, the selector valve 34 connected to the rotary shaft B 15 of the subordinate driven gear 16 can be rotated.

The operation of shifting the selector valve 34 will be described in more detail below.

In this embodiment, the gear C 66 of the main drive gear 17 has 60 teeth and the gear D 67 has 40 teeth. Further, the auxiliary gear 65 has 30 teeth and the subordinate driven gear 16 has 40 teeth.

The selector valve 34 in this embodiment is required to rotate through 90° forwards and backwards. Since both the subordinate driven gear 16 and the gear D 67 of the main drive gear 17, each of which is engaged with the timing belt 64, have 40 teeth, the gear D 67 is required to be rotated through 90° in order to rotate the subordinate driven gear 16 through 90°. Herein, since the gear C 66 and the gear D 67 are fixed to each other such that they are rotated through the same angle, the gear C 66 is also required to be rotated through 90° in order to rotate the gear D 67 through 90°. Further, since the gear C 66 has 60 teeth, 15 teeth correspond to 90°. In order to rotate the gear C 66 through 90°, therefore, the auxiliary gear 65 engaging with the gear C 66 is required to be rotated in amount corresponding to 15 teeth. Stated another way, the selector valve 34 is rotated through 90° forwards and backwards by rotating the auxiliary gear 65 through 180° forwards and backwards with the rotary actuator 11. Thus, by using the main drive gear 17 comprising of the gear C 66 and the gear D 67 capable of providing a different gear ratio and by transmitting the driving force of the rotary actuator 11 through the auxiliary gear 65, the selector valve 34 can be rotated by a driving force that is ½ of that required in Embodiment 1.

Generally, a small-sized rotary actuator has a weak driving force. With the construction of this embodiment, however, the selector valve can be sufficiently driven even in the case of using the rotary actuator having a weak driving force, and hence a value in practical use is great.

On the other hand, the selector valve 34 can also be rotated at a higher speed by constructing the gear C 66 and the gear D 67 such that the former has a smaller number of teeth than the latter. Thus, by adjusting the gear ratio depending specifications of the ejector, the balance between the driving force and the rotational speed can be made optimum.

Similarly, the subordinate driven gear 16 can also be connected to the selector valve 34 through an auxiliary gear to make the driving force and the rotational speed adjustable.

In the ejector of this embodiment, since the gear ratio is changed by using the auxiliary gear 65, the selector valve 34 can be smoothly rotated by a larger force, or it can be rotated at a higher speed.

Also, by using the auxiliary gear 65, the driving force and the rotational speed can be adjusted without increasing the front-side lateral width of the base block 1. In addition, since the timing belt 64 has a smaller width than the chain, a space required for constructing the transmission section 50 can be reduced. As a result, the front-side lateral width W of the base block 1 can be narrowed and hence the overall width of the ejector can be made smaller.

Further, since the timing belt 64 has elasticity, it can absorb certain errors in machining accuracy and installation positions of the members constituting the transmission section, such as the gears. In other words, because those errors, etc. are absorbed by the elasticity of the timing belt, the operation is not adversely affected by the certain errors, etc. Accordingly, production of the ejector is facilitated and the production cost can be reduced. Moreover, since the timing belt 64 is lighter than the chain, it is possible to reduce a loss generated in the power transmission and to improve response of the ejector.

What is claimed is:

1. A liquid material ejector comprising:

a liquid material supply port through which a liquid material is supplied;

a nozzle for ejecting the liquid material;

a valve block having a metering bore to be filled with the liquid material and a liquid material supply channel communicating with the liquid material supply port;

a selector valve having a first position for allowing communication between the metering bore and the liquid material supply channel and a second-position for allowing communication between the metering bore and the nozzle;

a plunger advancing and retracting in the metering bore;

a plunger driver having a plunger actuator for driving the plunger to advance and retreat; and a valve driver having a valve actuator for driving the selector valve to select the first position or the second position, wherein the plunger actuator and the valve actuator are arranged in a longitudinal direction of the liquid material ejector wherein the liquid material ejector further comprises a base extending along a moving direction of the plunger, the base comprises a front surface to which the valve block and the plunger driver are fixed, and the valve block, the plunger driver and the valve driver are arranged along a straight line viewed from the front.

2. The liquid material ejector according to claim 1, wherein a width of the base is the widest when seeing from the front.

3. The liquid material ejector according to claim 2, wherein each of a width of the valve block, a width of the plunger driver and a width of the valve driver is narrower than the width of the base.

4. The liquid material ejector according to claim 3, further comprising:

a coupling communicating the liquid material supply channel with a liquid material reservoir, and arranged in front of the valve block.

5. The liquid material ejector according to claim 4, further comprising:

an actuator rod which the plunger actuator has, the actuator rod advancing and retreating in the moving direction of the plunger, a joint portion fixedly connecting the plunger and the actuator rod, and a slide rail fixed to the base and on which the joint portion is movably mounted, the slide rail extending along the moving direction of the plunger.

6. The liquid material ejector according to claim 5, wherein the joint portion connects one end of the plunger and one end of the actuator rod.

7. The liquid material ejector according to claim 6, wherein the valve block has an O-ring fixedly fitted to an opening of the metering bore to which the plunger is inserted and an O-ring retainer retaining the O-ring fixedly disposed on the upper side of the valve block, and a valve block guide fixing the O-ring retainer from the upper side of the valve block, the valve block guide is fixedly disposed on the front surface of the base.

8. A liquid application apparatus having a head in which a plurality of liquid material ejectors each according to claim 7 are arranged side by side in a lateral direction.

* * * * *